US005141266A

United States Patent [19]

Braun et al.

[11] Patent Number: 5,141,266

[45] Date of Patent: Aug. 25, 1992

[54] SLIDING DOOR ROTARY LATCH SYSTEM

[75] Inventors: Jack A. Braun, Brunswick; Donald McFarland, Parma; Paul Shuss, Ashtabula, all of Ohio

[73] Assignee: Cleveland Hardware & Forging Company, Cleveland, Ohio

[21] Appl. No.: 488,311

[22] Filed: Mar. 5, 1990

[51] Int. Cl.[5] ..... E05C 3/10

[52] U.S. Cl. ..... 292/49; 292/254; 292/216; 292/26; 292/DIG. 46; 292/48

[58] Field of Search ..... 292/254, 216, 49, 45, 292/26, 48, DIG. 21, DIG. 46

[56] References Cited

U.S. PATENT DOCUMENTS

| | | | |
|---|---|---|---|
| 952,715 | 3/1910 | Shonka | 292/254 X |
| 2,767,571 | 10/1956 | Dingman et al. | 292/280 X |
| 4,457,146 | 7/1984 | Weinerman | 292/DIG. 26 X |
| 4,835,997 | 6/1989 | Akright | 292/216 X |
| 4,911,487 | 3/1990 | Rachocki | 292/216 |
| 4,917,420 | 4/1990 | Rogers, Jr. | 292/216 X |

*Primary Examiner*—Richard E. Moore

*Attorney, Agent, or Firm*—Calfee, Halter & Griswold

[57] ABSTRACT

A sliding door rotary latch system includes a handle assembly mounted on the sliding door adjacent its leading edge, a rotary latch assembly and locking mechanism mounted on the front post of the door frame cooperating with a strike bar on the handle assembly selectively to latch the sliding door in its fully closed position and a rear latch plate mounted on the back post of the door frame cooperating with the handle assembly selectively to latch the sliding door in its fully open position. The door mounted handle assembly includes an outer pivotal handle, an inner pivotal handle, and an inner actuation mechanism operative to allow either handle independently of the other to actuate either a pivotal front cam actuator arm or a rear pivotal latch independent of the other. Either handle may be held in its pivoted position toward the direction of sliding movement of the door during that sliding movement without adversely effecting the latching action when the door is either fully closed or opened. The handles are vertically spaced but transversely aligned relative to one another.

19 Claims, 8 Drawing Sheets

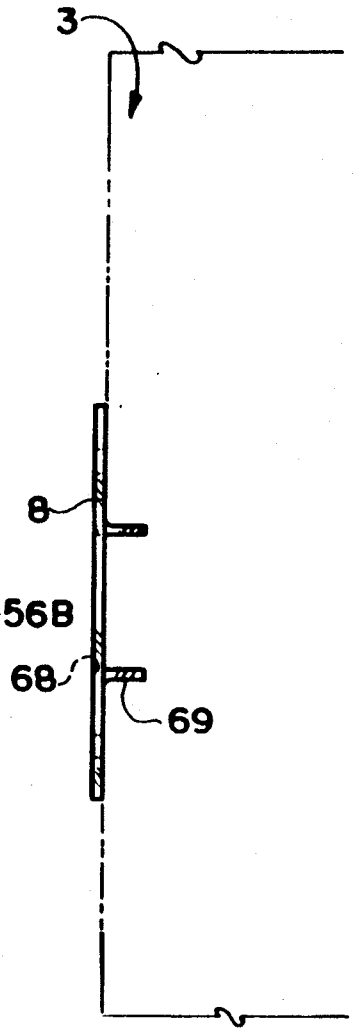
FIG. 2A3
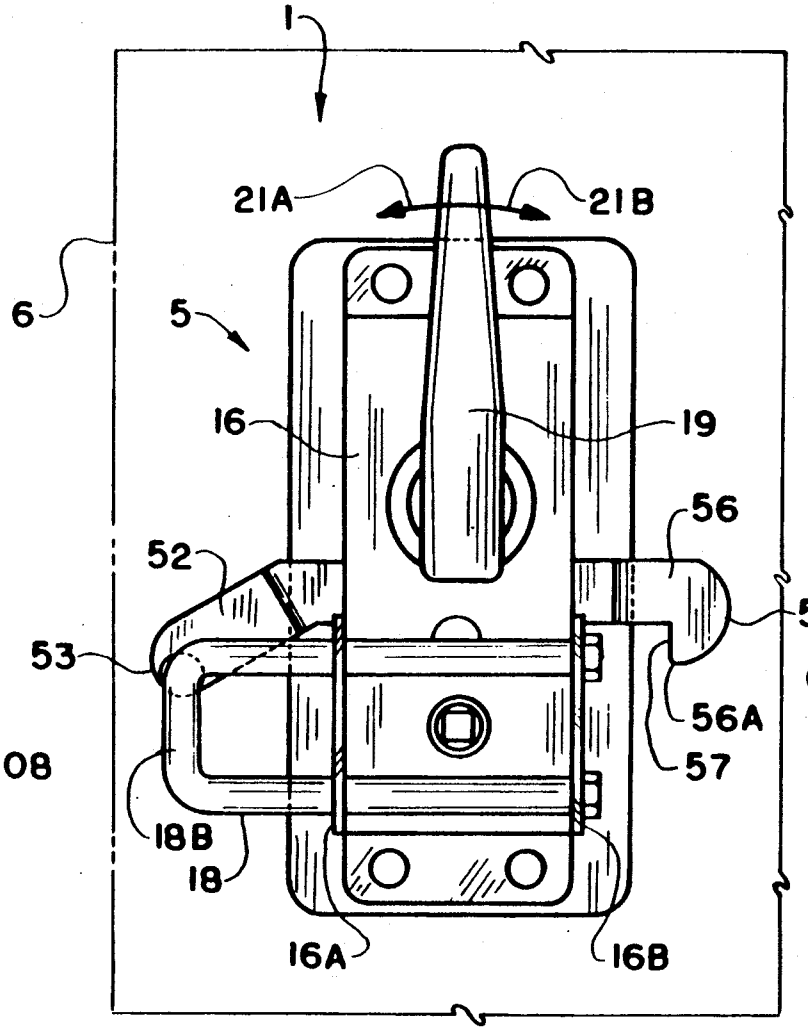
FIG. 2A2
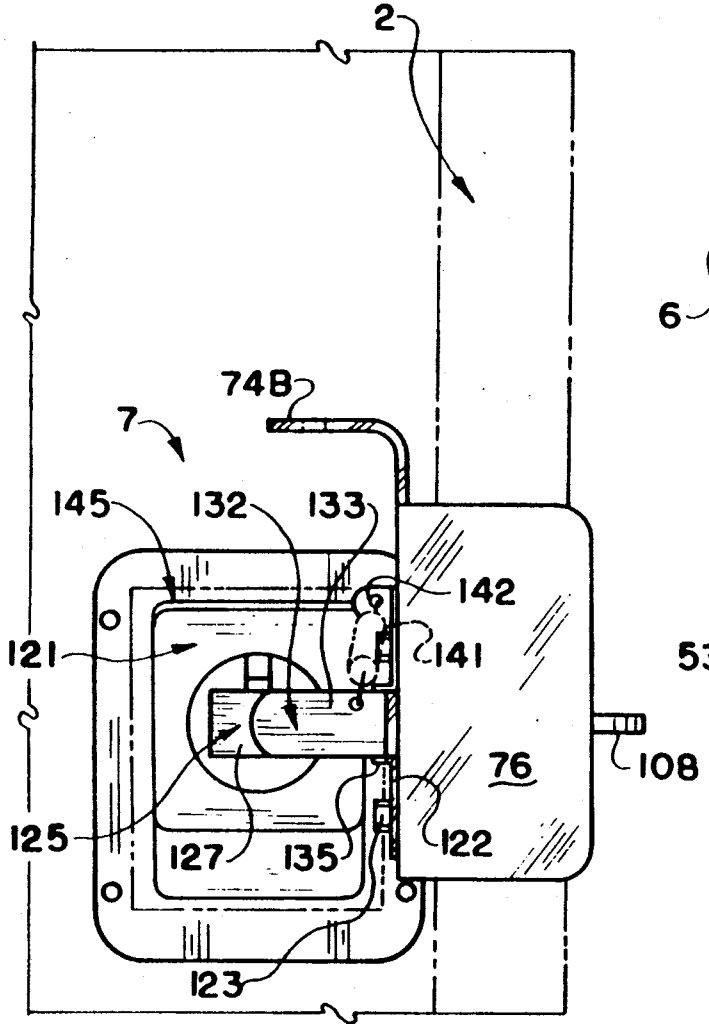
FIG. 2A1

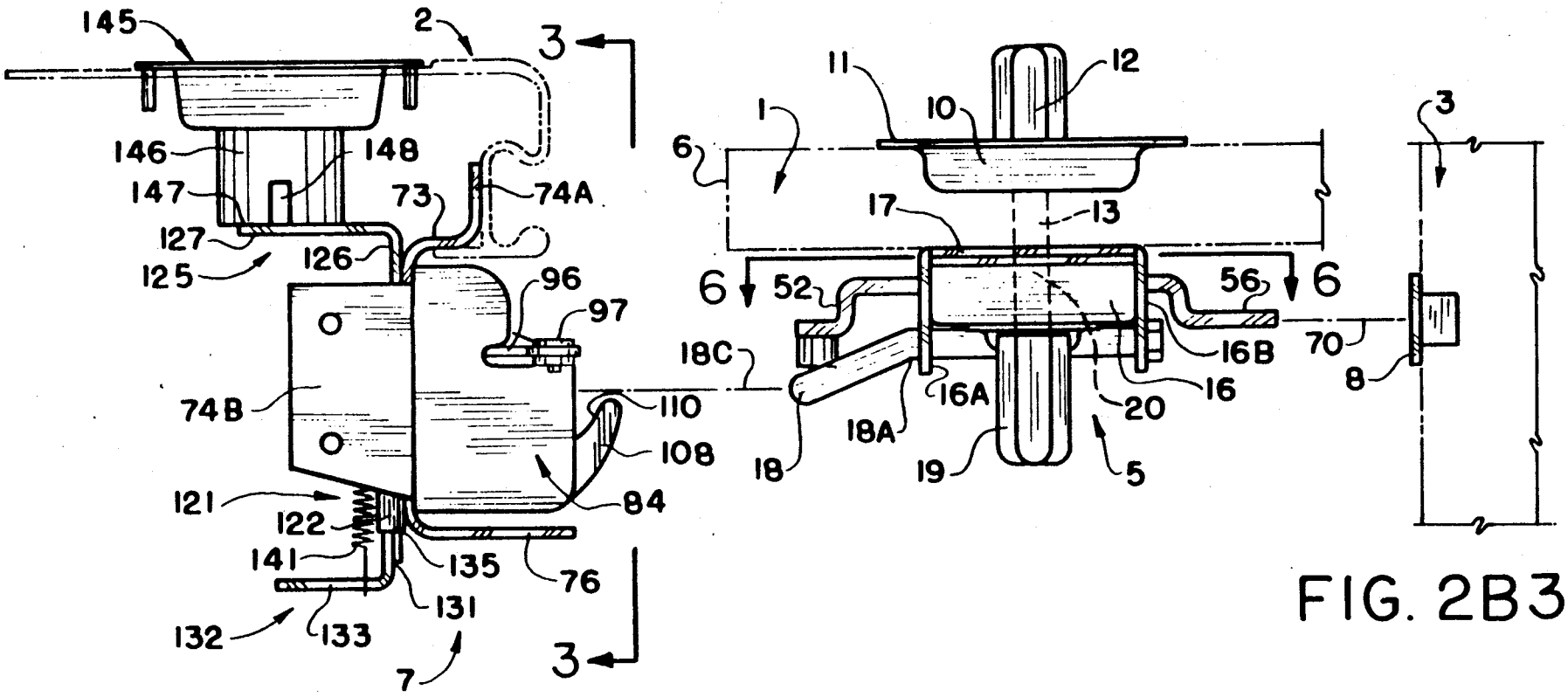
FIG. 2B3
FIG. 2B2
FIG. 2B1

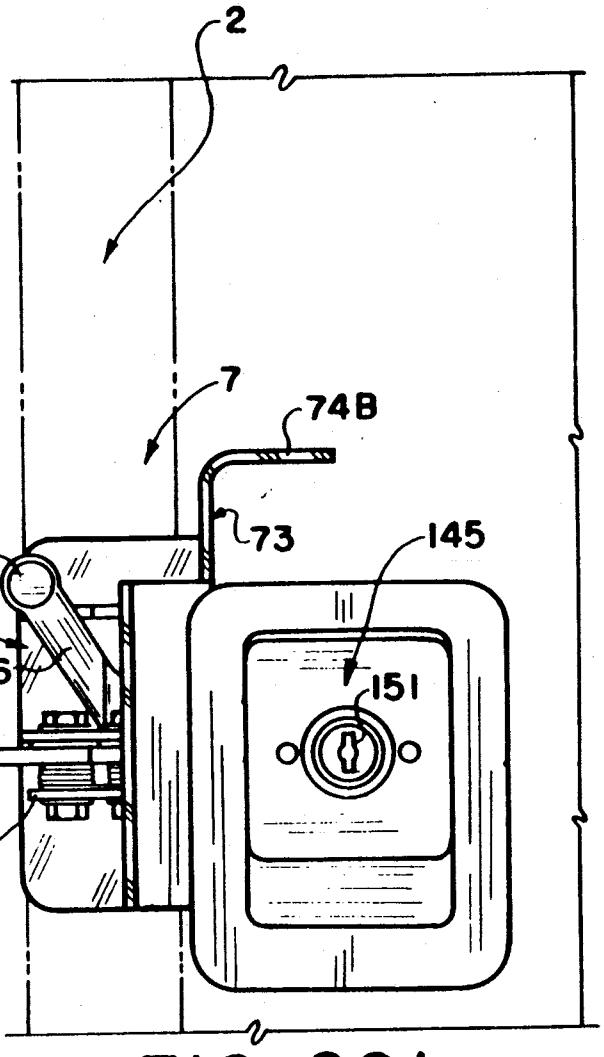
FIG. 2C1
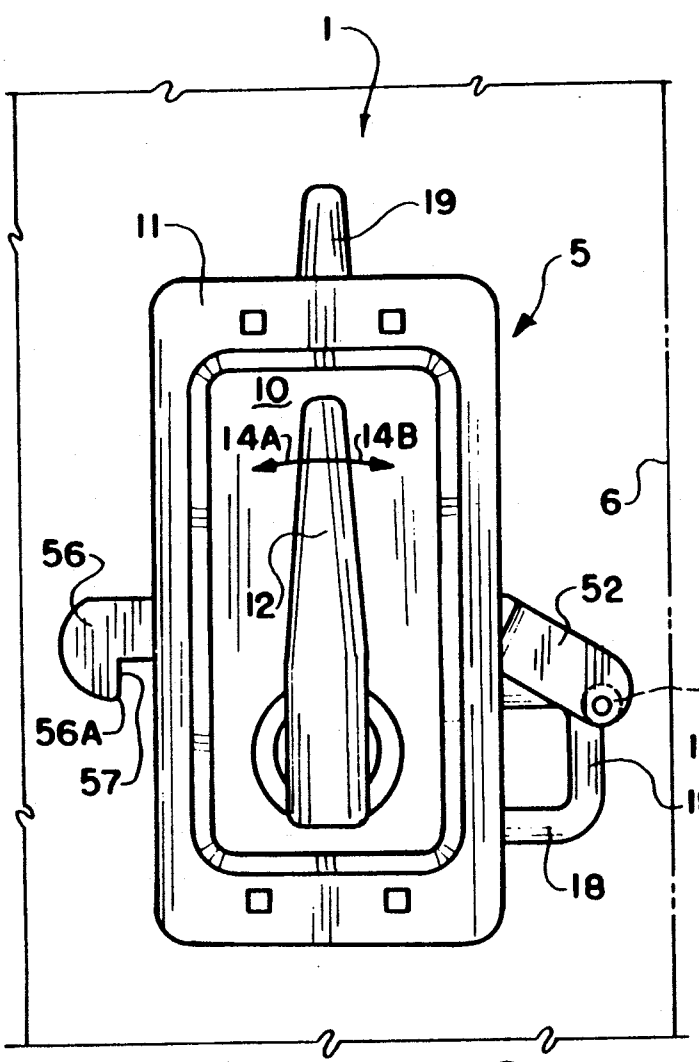
FIG. 2C2
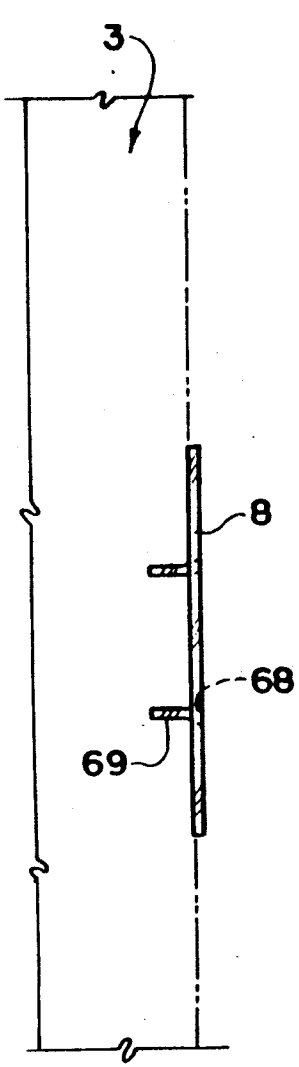
FIG. 2C3

SLIDING DOOR ROTARY LATCH SYSTEM

FIELD OF THE INVENTION

The present invention relates to a sliding door rotary latch system principally for use on sliding truck doors.

BACKGROUND OF THE INVENTION

Latch systems are commonly used on sliding doors for trucks. In the first generation of such systems, the handle assembly is mounted on the sliding door and includes inner and outer handles pivoting on a common axis. Pivotal actuation of either handle concurrently actuated forwardly extending and rearwardly extending pivotal latches. These latches cooperated with horizontally extending strike bars mounted to the front and rear posts of the door frame.

The first generation sliding door latch system had several operational disadvantages. For example, if either handle was pivoted toward the receiving post at the time the door reached either a fully closed or fully opened position, the pivotal latch was not in an operative position to complete the latch. Thus, the actuated handle had to be returned to its neutral position before the door was fully closed or fully opened in order for a proper latch to be completed to retain the door in the selected position. Moreover, the horizontal strike bars mounted on the front and rear posts of the door frame extended into the door opening to reduce clearance for ingress and egress. This reduction in clearance was undesirable because people leave and enter the truck carrying loads requiring as much clearance as possible. In addition, the strike bar being horizontally mounted limited vertical freedom or flexibility for the sliding door when in its closed and latched position. Some vertical freedom for the door is desirable to minimize the chances of the door seizing in the slide tracks.

Improvements were made in this first generation system, as shown for example in U.S. Pat. No. 4,126,340. In such patent, the handle assembly includes an inner mechanism allowing the front latch to be pivotally actuated independently of the back latch and vice versa.

In a second generation system, the handle assembly on the sliding door had inner and outer pivotal handles coaxially mounted and selectively actuated to operate front or back rotary latches through an internal gear mechanism. This second generation system suffered many of the same disadvantages as a number of the first generation system. Specifically, if either handle remained in its pivotal actuation position at the conclusion of the sliding door movement, the door would not properly latch shut or open. In addition, the horizontal strike bars on the front and back door frame posts reduced door opening clearance and limited freedom for vertical movement of the door in the latched condition.

SUMMARY OF THE INVENTION

The present invention provides a sliding door rotary latch system to overcome or minimize some of the problems in the prior art systems. In the invention, the rotary latch and locking assembly are mounted on the front or A post of the door frame, s vertically mounted strike bar and handle assembly are mounted on the sliding door and a rear latch plate is mounted to the rear or B post of the door frame.

The handle assembly includes a pivotal inner handle and a pivotal outer handle which are mounted in vertically spaced but transversely aligned relationship relative to one another. Pivotal movement of either handle is operative through an inner actuation mechanism to pivot either a forwardly extending cam arm or a rearwardly extending pivotal latch. This inner actuation mechanism includes two lost motion linkage drive connections with a pivotal front cam arm and a pivotal rear latch to provide quadrilateral motion. With such quadrilateral motion, either the inner or outer handle can be pivoted independently of the other to actuate either the forwardly extending pivotal cam arm or the rearwardly extending pivotal rear latch independently of the other.

During closure of the door, the vertically oriented strike bar mounted on the sliding door is in axial alignment with the rotary latch on the rotary latch assembly. The moving strike bar drives the rotary latch to its closed position, with the rotary latch concurrently pivoting a tripping pawl to a position in which it catches and holds the rotary latch in its closed position. In such closed position, the vertically extending strike bar is captured by the rotary latch and rotary latch assembly. The vertical orientation of the strike bar provides for some vertical movement of door in its closed position.

To open the door, either the inner or outer handle is pivoted away from the front post to actuate the pivotal cam actuator arm independently of the rear latch. The cam actuator arm is in alignment with and actuates a pivotal trip lever on the rotary latch assembly. Pivotal movement of this trip lever rotates the tripping pawl of the rotary latch assembly to release the rotary latch to return to its open position under spring bias. The return of the rotary latch to its open position allows the vertical strike bar on the sliding door to be withdrawn from the rotary latch assembly to open the door.

In opening or closing the door, the actuated handle can be held in its pivoted position toward the post being approached and a proper latch can nevertheless be completed to hold the door in its closed or open position. The inner actuation mechanism operated by vertically spaced handles provides the quadrilateral motion needed to obtain the latching even though the pivoted handle has not been released to its neutral position.

These and other objects and advantages of the present invention will become apparent as the following description proceeds. The invention, then, comprises the features hereinafter fully described and particularly pointed out in the claims, the following description and annexed drawings setting forth in detail certain illustrative embodiments of the invention, these being indicative, however, of but a few of the various ways in which the principles of the invention may be embodied.

DESCRIPTION OF THE DRAWINGS

In the drawings:

FIGS. 2A1, 2A2, 2A3 are an elevation from inside the vehicle showing the handle assembly and strike bar mounted on the partially open sliding door, the rotary latch assembly mounted on the front post of the door frame and the rear strike plate mounted on the rear post of that door frame, with the door and door frame being shown in phantom and in dimensionally reduced or abbreviated form;

FIGS. 2B1, 2B2, 2B3 are a plan view of FIGS. 2A1, 2A2. 2A3;

FIGS. 2C1, 2C2, 2C3 are an elevation similar to FIGS. 2A1, 2A2, 2A3 taken from outside the vehicle;

FIG. 3 is an end elevation of the rotary latch assembly mounted on the front post of the door frame taken generally along the plane 3—3 in FIG. 2B1 and showing the details of the rotary latch assembly including an actuator lever, a tripping pawl and a rotary latch;

DETAILED DESCRIPTION OF THE DRAWINGS

Figure 1:
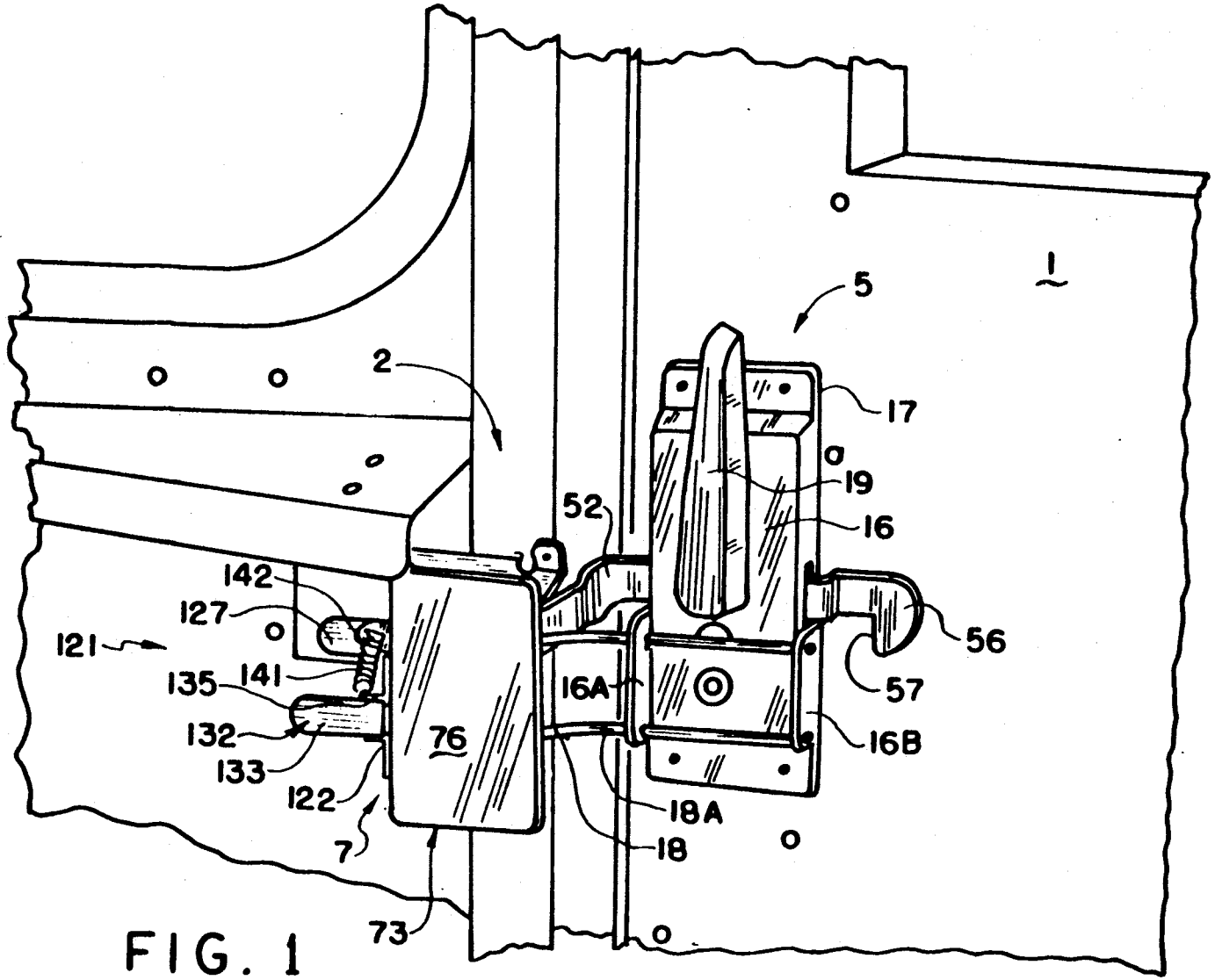
FIG. 1 is a perspective view from inside a vehicle showing the rotary latch system of the present invention mounted on a sliding door of that vehicle, with the sliding door being illustrated in its closed and latched position.
Figure 3:
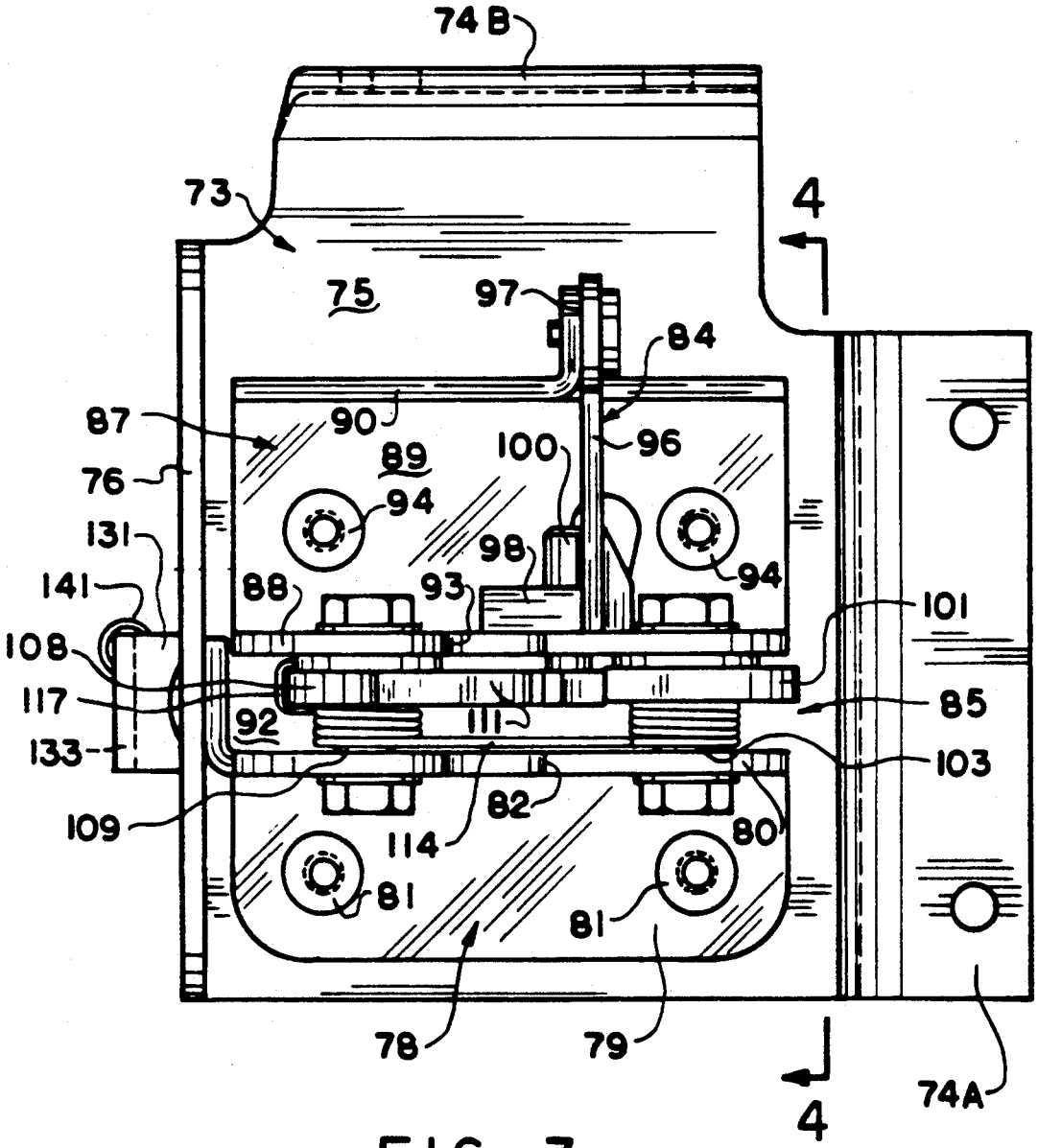
Figure 4:
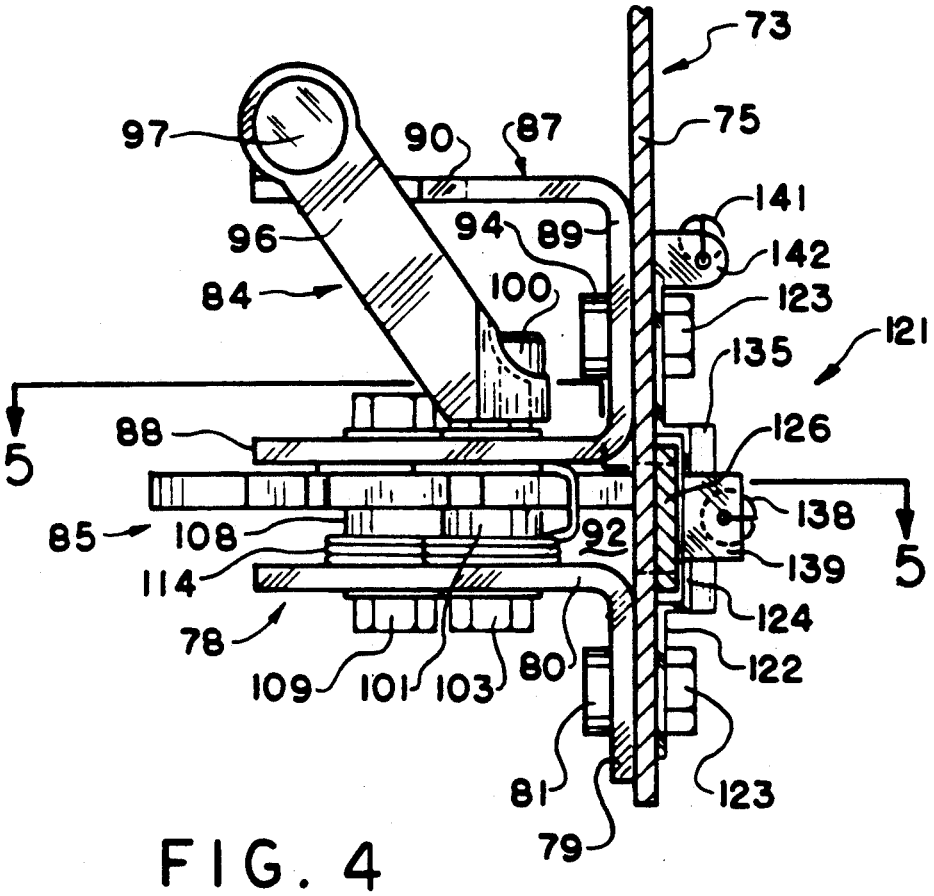
FIG. 4 is a side elevation of the rotary latch assembly, taken generally along the plane 4—4 of FIG. 3.

Turning now in more detail to the drawing and initially to FIGS. 1 through 2C3, a sliding door 1 is mounted for reciprocal sliding movement between the closed position covering the door opening and an open position totally uncovering the door opening. The door opening is formed by a door frame including a front vertically extending post, indicated generally at 2, a top, horizontally extending post (not shown), and a rear vertically extending post indicated generally at 3. The rotary latch system of the present invention is preferably mounted on a sliding door utilized in a vehicle or the like, although the present invention can be adapted for use with any sliding door in any application. The top horizontal post and/or floor can be provided with track means to guide the door in its sliding movement.

In the sliding door rotary latch system of the present invention, the handle assembly, indicated generally at 5, is mounted on and extends through the door 1 adjacent its front edge 6. When the door 1 is in its fully closed position, the handle assembly 5 and a strike bar mounted thereon cooperate with a rotary latch assembly, indicated generally at 7, to temporarily secure the door 1 in its closed position. The rotary latch assembly 7 is mounted on the front vertical post 2 of the door frame. When the door is in its fully open position, the handle assembly 5 selectively cooperates with a rear strike plate 8 to temporarily hold the door 1 in its fully open position. The strike plate 8 is mounted on the rear vertical post 3 of the door frame. Each of these major components of the sliding door rotary latch system will be described in detail hereinafter, followed by a brief description of the operation of the system.

Handle Assembly 5

The handle assembly 5 is best illustrated in FIGS. 1, 2A1 through 2C3 and 6 through 8. As best shown in the FIGS. 2B1, 2B2, 2B3 and 2C1, 2C2, 2C3, the handle assembly 5 includes a first outer housing 10 having a peripheral attachment skirt 11 extending therearound. The first outer housing 10 is passed through an opening in the outer panel of the door and is principally received within the cavity inside door 1. The outer housing 10 is secured to the door 1 by suitable fasteners passing through the peripheral skirt 11 into the outer door panel.

An outer generally vertically oriented first handle 12 is pivotally mounted adjacent its bottom to the first housing 10. The lower end of the pivotally mounted outer handle 12 has a square shank 13 mounted thereon and extending inwardly therefrom, as best shown in FIGS. 2B1, 2B2, 2B3. This square shank 13 is operatively connected with the inner actuation mechanism of the handle assembly 5, as will be described in more detail below, to actuate the handle assembly when the outer handle 12 is selectively pivoted in one direction or the other. As shown by the arrows 14A and 14B, outer handle 12 may be selectively pivoted in either direction for purposes to be described in more detail below.

The handle assembly 5 also includes a second inner housing 16 having a base wall 17 secured to the inner panel of door 1. A U-shape strike bar 18 is secured to and extends from spaced ears 16A and 16B on the innerface of second housing 16. The U-shape strike bar is bent at 18A to place the end 18B of the strike bar in axial alignment with rotary latch assembly 7, as indicated by axis 18C in FIGS. 2B1, 2B2, 2B3. The forward end 18B of strike bar 18 is behind the front edge 6 of the door 1 to provide clearance for ingress and egress and is vertically oriented to provide some vertical freedom for the door 1 when in its closed and latched condition.

A second inner handle 19 is pivotally mounted adjacent its bottom to the second housing 16. The bottom end of the generally vertically extending inner handle 19 has a square shank 20 connected thereto and extending outwardly therefrom into the second housing 16. As best shown by the arrows 21A and 21B in FIG. 2A2 inner handle 19 can be selectively pivoted in either direction for purposes to be described in more detail below.

Figure 6:
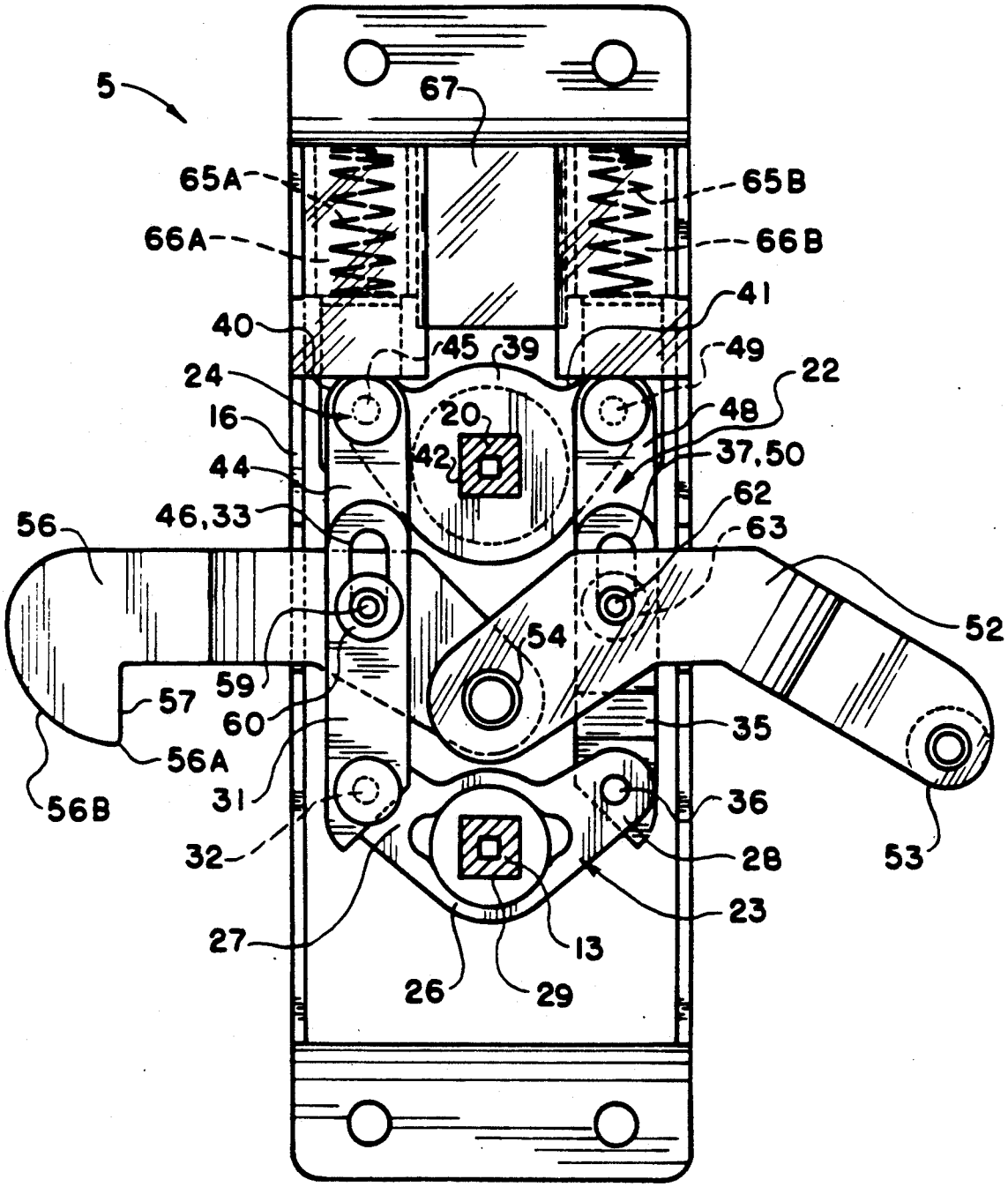
FIG. 6 is an elevation of the inner actuation mechanism for the handle assembly taken generally along the plane 6—6 in FIG. 2B2 and illustrating the lost motion drive connections for the forwardly extending cam actuator arm and rearwardly extending rear latch.

As is apparent from FIGS. 2A1 through 2C2, first or outer handle 12 and second or inner handle 19 are in transverse alignment with one another but are vertically spaced relative to one another. Specifically, outer pivotal handle 12 is mounted on the outside of door 1 below the mount of inner handle 19 on the inside of door 1. This vertical spacing allows the first square shank 13 on first handle 12 to be spaced below but in vertical alignment with second vertical shank 20 on second or inner pivotal lever 19, as is best shown in FIG. 6. Pivotal movement of outer handle 12 and square shank 13 can thus be selectively actuated in the desired arcuate direction independently of inner handle 19 and square shank 20, and vice versa.

Selective pivotal movement of first square shank 13 or second square shank 20 by pivoting handle 12 or handle 19, respectively, selectively operates the inner actuation mechanism of the handle assembly 5. This inner actuation mechanism, indicated generally at 22, is positioned within and covered by second housing 16 and base plate 17. The inner actuation mechanism 22 includes a first tumbler and linkage assembly, indicated generally at 23 in FIGS. 6 and 7, and a second tumbler and linkage assembly, indicated generally at 24 in FIGS. 6 and 8.

The first tumbler and linkage assembly 23 includes a tumbler body having a central section 26 and first and second arms 27 and 28 extending outwardly and slightly upwardly therefrom in generally opposite directions.

The center section 26 of the tumbler body includes a square hole 29 tightly frictionally receiving the first square shank 13 on the pivotal outer handle 12. Pivotal movement of the outer handle 12 will thus pivotally move the first tumbler body for operation of the first tumbler linkage assembly 23.

Such first assembly 23 includes a first link 31. The lower end of first link 31 is pivotally connected to the distal end of first arm 27, as indicated at 32. A first elongated slot 33 is provided in first link 31 adjacent its upper end. The first tumbler linkage assembly 23 also includes a second link 35. The lower end of second link 35 is pivotally connected to the distal end of second arm 28, as indicated at 36. A second elongated slot 37 is provided in the second link 35 adjacent its upper end. The first and second elongated slots 33 and 37, respectively, of the first tumbler linkage assembly 23 cooperate with elongated slots in the second tumbler linkage assembly 24 cooperatively to define a part of the lost motion drive connections.

To this end, the second tumbler linkage assembly 24 includes a second tumbler body having a second central section 39 and third and fourth arms 40 and 41 extending outwardly therefrom in generally opposite directions. The second central section 39 of the second tumbler body includes a generally centrally positioned square hole 42. This square hole 42 tightly frictionally receives the second square shank 20 on second or inner handle 19. Selective pivotal movement of inner handle 19 will pivotally move the second square shank 20, which in turn will pivotally move the second tumbler body for operation of the second tumbler linkage assembly 24.

This second tumbler linkage assembly 24 includes a third link 44 pivotally connected at its upper end to the distal end of third arm 40, as indicated at 45. A third elongated slot 46 is provided in the third link 44 adjacent its bottom end. The upper end of first link 31 and the lower end of third link 44 are superimposed upon on one another with elongated slots 33 and 46 generally being in alignment with one another upon assembly.

The second tumbler linkage assembly 24 further includes a fourth link 48. The upper end of fourth link 48 is pivotally secured to the distal end of fourth arm 41 on the second tumbler body, as indicated at 49. The lower end of fourth link 48 has a fourth elongated slot 50 passing therethrough. When the inner actuation mechanism is assembled, the upper end of second link 35 and the lower end of fourth link 48 are superimposed upon one another, with elongated slots 37 and 50 thereof generally being in mating alignment. The two pairs of aligned slots 33 and 46 and 37 and 50, respectively, cooperatively define a part of the first and second lost motion drive connections.

For this purpose, the handle assembly 5 includes a forwardly extending cam actuator arm 52 having a cam roller 53 mounted on its distal end. The cam actuator arm 52 is pivotally mounted at its proximal end to the second housing 16 around (but not connected to) fixed pivot shaft 54. The handle assembly 5 further includes a rearwardly extending, pivotally mounted rear latch 56. The distal end of rear latch 56 has a keeper shoulder 57 thereon. The proximal end of rear latch 56 is pivotally mounted to second housing 16 around (but not connected to) fixed pivot shaft 54. Thus, forwardly extending cam actuator arm 52 and rear latch 56 are pivotally mounted around a common shaft 54 in second housing 16.

The pivotal rear latch 56 has a first drive pin 59 connected thereto and extending outwardly therefrom. The first drive pin 59 extends through aligned elongated slots 33 and 46 in first and third links 31 and 44, respectively. The end of first drive pin 59 has a cap nut 60 secured thereon to retain the first and third links in their superimposed and generally aligned positions. As shown in FIG. 6, the first drive pin 59 is positioned at the bottom of aligned slots 33 and 46 when the handle assembly is in its at rest position, as illustrated in FIG. 6.

The forwardly extending cam actuator arm 52 has a second drive pin 62 connected thereto and extending therefrom. The second drive pin 62 extends through mated elongated slots 37 and 50 in second and fourth links 35 and 48, respectively. The end of second drive pin 62 has a cap nut 63 secured thereon to retain second and fourth links 35 and 48 in their superimposed and generally aligned positions. Second drive pin 62 is positioned at the bottom of mated slots 37 and 50 in the at rest position of the handle assembly illustrated in FIG. 6. Thus, first drive pin 59 and second drive pin 62 are each in the same relative position at the bottom of their respective mated elongated slot pairs when the handle assembly 5 is in its at rest position.

The first drive pin 59 and normally aligned elongated slots 33 and 46 operatively associated therewith cooperatively form a first lost motion drive connection for rear latch 56. Second drive pin 62 and normally aligned elongated slots 37 and 50 operatively associated therewith cooperatively form a second lost motion drive connection for the forwardly extending cam actuator arm 52.

As viewed in FIG. 6, when the first tumbler body is pivoted in a clockwise direction by selective pivotal movement of first handle 12 and first shank 13, the first link 31 will be driven upwardly. Link 31 and slot 33 therein will accordingly pivot rear latch 56 in an upward direction around pivot shaft 54 due to the driving engagement between the lower end of slot 33 and the first drive pin 59. This pivotal movement of rear latch 56 will be independent of any movement of the forwardly extending cam actuator arm 52. Specifically, first drive pin 59 will ride upwardly in third slot 46 without imparting any motion to third link 44. Moreover, the clockwise pivotal movement of the first tumbler body as viewed in FIG. 6 will move the third link 35 downwardly with this movement being accommodated by second drive pin 62 remaining stationary as second elongated slot 37 moves therepast. With the free relative movement of first drive pin 59 in third slot 46 and second drive pin 62 in second slot 37, the forwardly extending cam arm 52 remains stationary during such actuation of rear latch 56.

Similarly, as viewed in FIG. 6, if first tumbler body in the first tumbler linkage assembly 23 is rotated in a counterclockwise direction by pivotal movement of outer handle 12, the second link 35 will be driven upwardly. The engagement between the lower end of slot 37 and second drive pin 62 will pivot actuator arm 52 upwardly around fixed pivot shaft 54. This pivotal movement of actuator arm 52 will be independent of any movement of rear latch 56. In this context, the second drive pin 62 moves upwardly along fourth elongated slot 50 without imparting any motion to fourth link 48. Moreover, the counterclockwise movement of the first tumbler body will move first link 31 downwardly. This downward movement will be accommodated by first drive pin 59 remaining motionless as elongated slot 33 slides therepast to provide a lost motion connection resulting in rear latch 56 remaining stationary. Therefore, pivotal movement of outer handle 12 in a selected direction can pivot either actuator arm 52 or rear latch 56 independent of the other, with pivotal movement of such outer handle 12 also being independent of any movement in the vertically spaced inner pivotal handle 19.

As viewed in FIG. 6, when the second tumbler body is pivoted in a clockwise direction by pivotal movement of inner handle 19 and shank 20, the third link 44 will be driven upwardly. This upwardly directed movement of third link 44 will pivot rear latch 56 upwardly about pivot shaft 54 because of the drive connection between the lower end of third slot 46 in third link 44 and first drive pin 59. This pivotal movement of rear latch 56 will be independent of any movement of actuator arm 52. In this regard, first drive pin 59 moves upwardly in slot 33 without imparting any motion to first link 31. Moreover, clockwise movement of the second tumbler body of second tumbler linkage assembly 24 will drive fourth link 48 downwardly. This downward movement will be accommodated by fourth elongated slot 50 moving relative to second drive pin 62 in a lost motion movement. This lost motion movement results in the forwardly extending actuating arm 52 remaining stationary during such actuation of the rear latch 56.

As viewed in FIG. 6, when the second tumbler body of second tumbler linkage assembly 24 is pivoted in a counterclockwise direction by selective pivotal movement of the inner handle 19 and shank 20, the fourth link 48 is driven upwardly. This upward movement of fourth link 48 pivots the forwardly extending cam actuator arm 52 upwardly about pivot shaft 54 due to the drive connection between the lower end of fourth slot 50 and the second drive pin 62. This pivotal actuation of cam actuator arm 52 is independent of any movement in the rear latch 56. In this regard, the second drive pin 62 freely rides upwardly in slot 37 without imparting any motion to second link 35. Moreover, counterclockwise movement of the second tumbler body drives the third link 44 downwardly. This downward movement is accommodated by elongated slot 46 freely moving along and past first drive pin 59 in a lost motion movement. Such lost motion movement results in rear latch 56 remaining stationary during such actuation of the cam actuator arm 52.

Therefore, pivotal movement of inner handle 19 in a selected direction can pivot either actuator arm 52 or rear latch 56 independent of the other, with such pivotal movement of inner handle 19 also being independent of any movement in the vertically spaced outer pivotal handle 12. This inner actuation mechanism 22 thus provides for quadrilateral motion to allow either handle independently of the other to actuate either cam arm 52 or rear latch 56 independently of the other. When the inner or outer handle is released after actuation, the inner actuation mechanism is returned to its at rest position.

For this purpose, the second tumbler body is normally held in its at rest position by balancing springs 65A and 65B spaced equal opposite distances on either side of the pivot fulcrum for the second tumbler body. These balancing springs 65A and 65B are respectively received in movable cups 66A and 66B. The balancing springs 65A and 65B are respectively captured between the upper end wall of housing 16 and the bottom blind ends of movable cups 66A and 66B to urge the blind ends of the cups tangentially against the opposed pivot connections for the third and fourth links. These balancing springs 65A and 65B accommodate pivotal movement of the second tumbler body and act to return the second body to its centered "at rest" position when the actuating force is withdrawn.

In this regard, when the second tumbler body is pivoted clockwise as viewed in FIG. 6 by actuation of handle 19, the cup 66A will move upwardly and the spring 65A will compress to accommodate that movement. When the handle 19 is released, spring 65A will expand to drive cup 66A downwardly to return the second tumbler body to its at rest position. When the second tumbler body is pivoted counterclockwise as viewed in FIG. 6 by actuation handle 19, cup 66B will move upwardly and spring 65B will compress to accommodate such movement. When handle 19 is released, spring 65B will expand to drive cup 66B downwardly to return the second tumbler body to its at rest position. The vertical reciprocal movements of cup 66A or cup 66B is guided externally by the side walls of the housing and internally by a guide channel 67 positioned therebetween.

The first or lower tumbler body returns to its at rest position under the force of gravity or may be provided with a similar balancing spring and cup system for that purpose. In the at rest position of the inner actuation mechanism, the handles 12 and 19 are in their upright or vertical "neutral" positions awaiting selective actuation to pivot either rear latch 56 for withdrawal from rear latch plate 8 or actuator arm 52 for release of rotary latch assembly 7.

Rear Latch Plate 8

Rear latch plate 8 is mounted to rear post 3 by suitable fasteners. Rear latch plate 8 includes an elongated latch slot 68 therein having a rearwardly projecting retention lip 69 at or adjacent its lower edge. The pivotal rear latch 56 is axially aligned with the latch slot 68 as is indicated by axis 70 shown in FIGS. 2B1, 2B2, 2B3. The lower end 56A of rear latch 56 adjacent keeper shoulder 57 is normally slightly below the bottom of slot 68 and retention lip 69. As the door is drawn into its fully open position, the curved end 56B of the rear latch will engage the bottom of slot 68 and cam the rear latch upwardly to allow the rear latch to pass through latch slot 68. This upward pivotal movement of rear latch 56 is accommodated by first drive pin 59 freely riding upwardly in mated first and third slots 33 and 46. When the keeper shoulder 57 has passed retention lip 69, the rear latch 56 pivots downwardly under gravity to place keeper shoulder 57 behind retention flange 69 to latch the door 1 in its open position. To disconnect such latch, handle 12 or handle 19 is pivoted away from rear post 3 (forwardly relative to the vehicle) to pivot rear latch upwardly about shaft 54 so that bottom edge 56A of rear latch 56 clears retention lip 69. This allows the door to be slid toward its closed position in which it is secured by rotary latch assembly 7.

Rotary Latch Assembly 7

Turning now in more detail to FIGS. 1, 2A1 through 2C3 and 3 through 5, the rotary latch assembly 7 includes a mounting bracket, indicated generally at 73. The mounting bracket includes attachment flanges 74A and 74B for securing the mounting bracket to front vertical post 2. The mounting bracket 73 includes a base wall 75 and a containment wall 76 extending generally at a right angle to base wall 75.

An L-shape back plate, indicated generally at 78, includes an attachment flange 79 and a back wall 80. The attachment flange 79 of back plate 78 is mounted on the base wall 75 of mounting bracket 73 by suitable fasteners 81. The back wall 80 includes a first strike bar slot 82. The back wall 80 of L-shape back plate 78 cooperates with an actuator cover plate assembly, indicated generally at 84, to mount the rotary latch mechanism, indicated generally at 85.

The actuator cover plate assembly 84 includes a U-shape actuator cover plate, indicated generally at 87. The U-shape actuator cover plate 87 includes a front wall 88, a base wall 89 and an actuator support wall 90. The front wall 88 faces and is spaced from back wall 80 of back-plate 78 to receive therebetween the rotary latch mechanism 85. The front wall 88 includes a second strike bar slot 93 therein, which is in vertical alignment with the first strike bar slot 82, as best illustrated in FIG. 3.

The base wall 89 of U-shape actuator cover plate 87 is secured to base wall 75 of mounting bracket 73 by suitable fasteners 94. The actuator mounting wall 90 extending at right angles away from base wall 89 has an actuator lever 96 pivotally mounted thereon.

The proximal end of actuator lever 96 is pivotally mounted to the outer end of actuator support wall 90 by a pivot connection 97. The lever 96 extends across the U-shape actuator cover plate 87 and has its distal end positioned adjacent front wall 88 thereof. This distal end of the actuator lever 96 has an actuator flange 98 formed at a right angle thereon which abuts an actuating stud 100. This stud extends from and is mounted on a tripping pawl 101 of the rotary latch mechanism 85.

Figure 5:
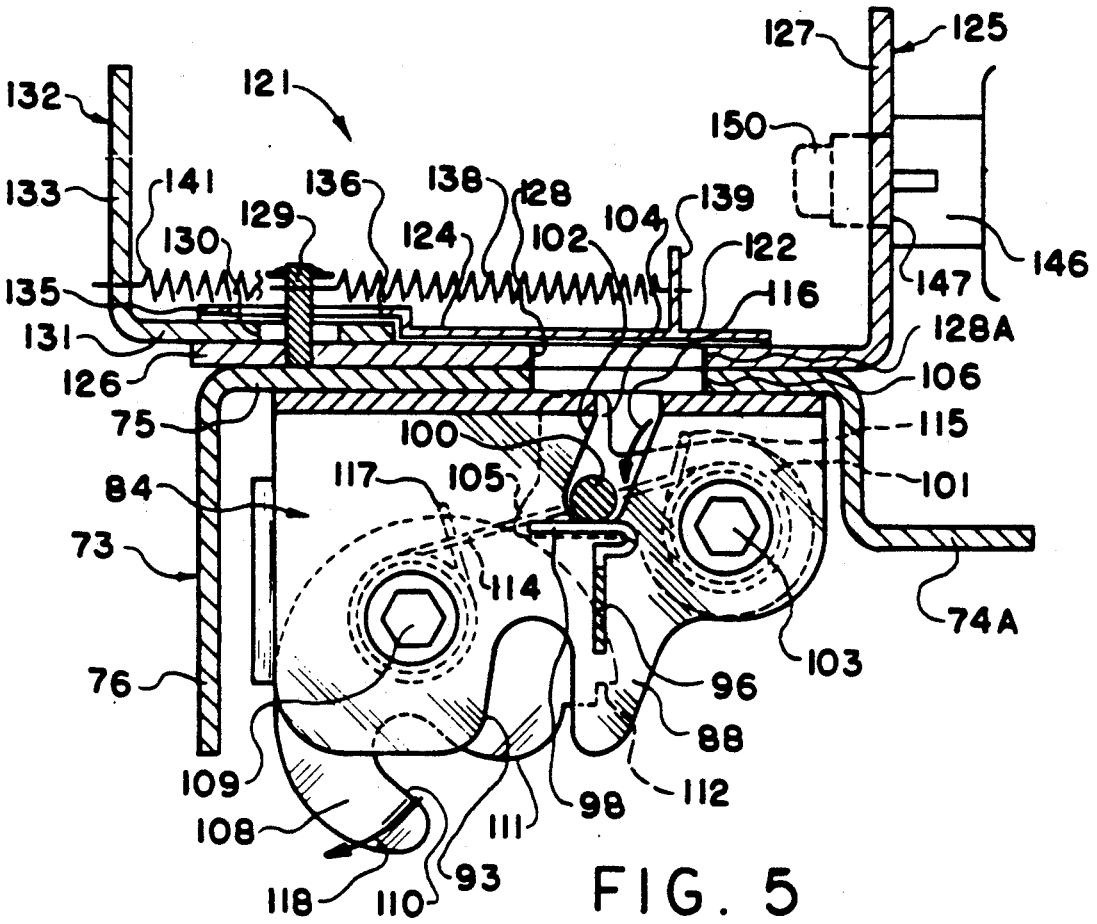
FIG. 5 is an elevation partially in section taken along the plane 5—5 of FIG. 4 illustrating the details of the rotary latch assembly in its unlatched and unlocked condition.
Figure 7:
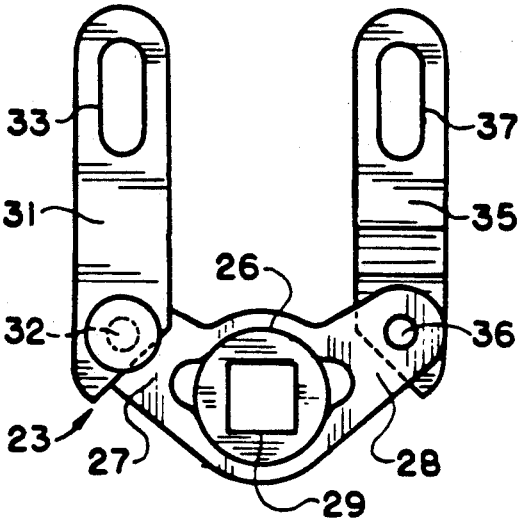
FIG. 7 is an elevation of the first tumbler linkage assembly selectively operated by the outside handle.
Figure 8:
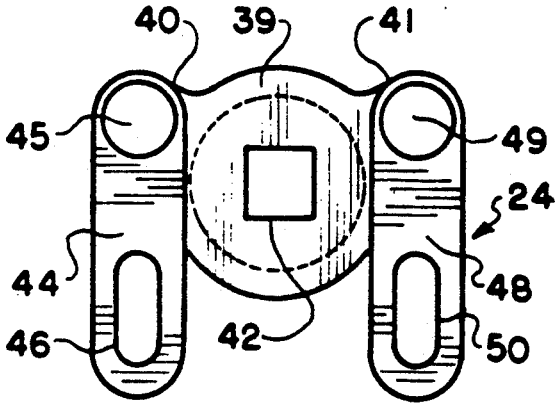
FIG. 8 is an elevation of the second tumbler linkage assembly selectively operated by the inside handle.

As best shown in FIG. 5, the actuator stud 100 extends through a stud slot 102 in front wall 88 of actuator cover plate 87 to its mount on tripping pawl 101. Tripping pawl 101 is pivotally mounted in the rotary latch mechanism 85 about a first fixed pivot shaft 103 extending between and connected at its opposite ends to front wall 88 and back wall 80. The pivotal tripping pawl 101 has a lock projection 104 and a tripping shoulder 105 extending generally radially outwardly therefrom. The lock projection 104 on counterclockwise pivotal movement of trip pawl 101 extends through a slot 106 in base wall 75 of mounting bracket 73 for selective cooperation with the locking mechanism, as will be described in more detail hereinafter. The tripping shoulder 105 selectively cooperates with the rotary latch 108 of the rotary latching mechanism 85.

Rotary latch 108 pivots about a second fixed shaft 109 extending between and connected at its opposite ends to front wall 88 and back wall 80. Rotary latch 108 includes an inwardly curved latch slot 110 and a curved strike face 111. The strike face 111 is between and positioned in vertical alignment with the first and second strike slots 82 and 93, respectively, when the rotary latch 108 is in its open position illustrated in FIG. 5. The rotary latch 108 also includes a peripheral tripping step 112, which selectively cooperates with the trip shoulder 105 on tripping pawl 101.

The rotary latch 108 and trip pawl 101 are each spring biased to their respective open positions illustrated in FIG. 5. For this purpose, a double torsion spring 114 extends between and around first and second shafts 103 and 109, respectively. One end 115 of the torsion spring 114 engages an edge of tripping pawl 101 normally to bias the same in a counterclockwise direction about first shaft 103, as indicated by arrow 116 in FIG. 5. The other end 117 of torsion spring 114 engages an edge of rotary latch 108 normally to bias the same in a clockwise direction about second fixed shaft 109, as indicated by arrow 118 in FIG. 5. The normal bias of the double torsion spring 114 is overcome when the door 1 is forcefully slid into its closed and latched position.

With such door movement, the end 18B of strike bar 18 on handle assembly 5 engages strike surface 111 on rotary latch 108 to drive the rotary latch in a counterclockwise direction as viewed in FIG. 5. Such counterclockwise rotation of pivot latch 108 will concurrently drive tripping pawl 101 in edgewise engagement therewith in a clockwise direction as viewed in FIG. 5. The clockwise rotation of the tripping pawl 101 results in the locking projection 104 thereon passing through slot 106 in base wall 75 of mounting bracket 73 into a locking slot on the locking mechanism as will be described in more detail hereinafter.

When the vertically oriented end 18B of strike bar 18 on handle assembly 5 bottoms out in first and second strike slots 82 and 93, respectively, the rotary latch 108 has rotated through a counterclockwise arc as viewed in FIG. 5 resulting in the end 18B of U-shape strike bar 69 being cooperatively captured in strike slot 110 of the rotary latch and in the first and second strike slots 82 and 93. The rotary latch 108 is positively retained in such latched position by the tripping shoulder 105 on peripheral tripping pawl 101 being received in the tripping step 112 on rotary latch 108.

To unlatch the strike bar 18 from the rotary latch 108, either the outer handle 12 or the inner handle 19 is pivotally actuated away from the rotary latch assembly 7 (rearwardly relative to the vehicle) to pivot actuating cam arm 52 upwardly about shaft 54. The cam roller 53 on actuating cam arm 52 is in axial alignment with actuator lever 96, as shown in FIGS. 2B1, 2B2, 2B3. The upward pivotal movement of the actuating cam arm 52 results in cam roller 53 pivotally driving actuator lever 96 in a counterclockwise direction about pivot 97 as viewed in either FIG. 2C1, 2C2, 2C3 or FIG. 4. This counterclockwise rotation of actuator lever 96 causes actuator flange 98 thereon to drive actuator stud 100 along stud slot 102. The movement of such actuator stud, which is mounted on the tripping pawl 101, imparts counterclockwise rotation to tripping pawl 101 as viewed in FIG. 5.

With such counterclockwise rotation of the tripping pawl, the tripping shoulder 105 on tripping pawl 101 is withdrawn from peripheral tripping step 112 on rotary latch 108. This releases rotary latch 108 for clockwise return to its unlatched position under the bias of double torsion spring 114. When the actuated handle 12 or 19 is released, double torsion spring 114 will return the tripping pawl in a counterclockwise direction to its unlatched at rest position. This tripping pawl rotation will return actuator stud 100 to the blind end of stud slot 102 ready for the next latching cycle. The double torsion spring 114 thus keeps the actuator stud 100 on tripping pawl 101 in physical engagement with the actuator flange 98 on pivotal actuator lever 96.

The rotary latch mechanism 85 including tripping pawl 101 and rotary latch 108 rearwardly extends just slightly beyond the front post 2 to improve the clearance for ingress and egress compared to most prior latching systems which created greater obstruction.

The rotary latch mechanism 85 may be locked to preclude the rotary latch 7 from latching the door if the door is open or from unlatching the door if the door is closed. The locking mechanism, which is operable from either inside or outside the vehicle, is indicated generally at 121.

The locking mechanism 121 includes a slide housing 122 secured to base wall 75 of mounting bracket 73 by suitable fasteners 123. The slide housing 122 includes a slide channel 124, which slidingly receives one leg of an L-shape cylinder stop link, indicated generally at 125. Such L-shape cylinder stop link includes a locking leg 126, which is slidingly received in channel 118, and cylinder stop leg 127.

As best shown in FIG. 5, locking leg 126 has a locking slot 128 therein. This locking slot 128 receives the locking projection 104 on tripping link 101 when the tripping link 101 has been pivoted to its latched or closed position. The end of locking leg 126 of L-shape cylinder stop link 125 has an upstanding return pin 129 mounted thereon. Such return pin 129 passes through a slot 130 in first leg 131 of an L-shape inside lock handle, indicated generally at 132. The second leg 133 of the inside lock handle 132 constitutes an actuating flange for manually actuating the lock mechanism 121 from inside the vehicle.

As best shown in FIG. 5, the end portion of first leg 131 of the L-shape inside lock handle 132 is superimposed upon the end portion of lock leg 126 of the L-shape cylinder stop link 125. First leg 131 selectively slides in an enlarged pocket 135 on channel guide 124. This enlarged pocket 135 includes a slot 136 through which return pin 129 passes. This return pin 129 is part of a spring biasing system operative to return the cylinder stop link 125 and inside lock handle 132 to their respective unlocked positions illustrated in FIG. 5 when the locking mechanism is unlocked.

To this end, a first compression spring 138 extends between the return pin 129 and a first fixed tab 139 on the slide housing 122. This first spring 138 normally urges the L-shape cylinder stop link 125 to the right as viewed in FIG. 5 to its unlatched position. Such movement of link 125 and the return pin 129 carried thereby will return inside lock handle 132 to the right into its respective unlocked position because of the drive connection between return pin 129 and slot 130 on first leg 131 of inside lock handle 132.

Similarly, a second compression spring 141 extends between second leg 133 on inside lock handle 132 and a second fixed tab 142 (FIG. 1) on slide housing 122. Such second spring 141 also biases the inside lock handle 132 to the right as viewed in FIG. 5. Thus, when the lock is released, second spring 141 returns inside L-shape lock handle 132 and L-shape cylinder stop link 125 to the right as viewed in FIG. 5 to their respective unlocked positions due to the drive connection between slot 130 and return pin 129. The cylinder stop link 125 and inside lock handle 132 can respectively be actuated from the outside by a keylock or from the inside by hand.

In this regard, a keylock assembly, indicated generally at 145, is mounted on the outside of the vehicle adjacent front vertical post 2 and in front of rotary latch assembly 7. The keylock assembly 145 includes a cylindrical housing 146 extending inside the vehicle. In the unlocked condition, the inner end 147 of cylindrical housing 146 engages the cylinder stop leg 127 of L-shape cylinder stop link 125. The cylindrical housing 146 telescopically receives a locking cylinder 150, which is shown in phantom lines in FIG. 5.

The keylock assembly includes an outer key slot 151 to receive a key (not shown). Initial 90° rotation of the key to a horizontal orientation allows the locking cylinder 150 to be either advanced from or retracted into cylindrical housing 146 depending upon its prior position. When the locking cylinder 150 has been fully advanced or retracted, the key is returned to its vertical position to hold the locking cylinder 150 in the selected position. The key may then be removed from the lock.

When the locking cylinder is advanced to its locked position shown in phantom lines in FIG. 5, the L-shape cylinder stop link 125 and inside lock handle 132 are driven to the left because of the engagement between locking cylinder 150 and cylinder stop leg 127. This movement drives locking slot 128 in locking leg 126 to the left to advance the right end 128A of that slot to the left into its locked position relative to the slot 106. In such locked position, if the rotary latch 108 is in its latched position, the end 128A of the slot blocks counterclockwise movement of locking projection 104 on tripping pawl 101 thereby precluding actuation of cam actuator arm 52 and actuator link 96 to keep the door latched and locked in its closed position. Further, in such locked position of slot 128, if the door is open, the end 128A of slot 128 will stop locking projection 104 before tripping pawl 101 can rotate far enough to catch rotary latch 108 in its latched position to keep the door from being fully closed and latched.

The locking mechanism 121 can also be actuated from inside the vehicle. For this purpose, the actuating flange 122 of L-shape inside lock handle 132 is pulled to the left as viewed in FIG. 5. This movement of lock handle 132 results in pulling the locking leg 126 of the cylinder stop link 125 to the left to position the end 128A of slot 128 in its locked position as described above. The first leg 131 of the inside lock handle 132 can be retained in its locked position by a suitable detent or by a notch on such leg engaging the end of pocket 132 on slide housing 122.

The locking mechanism can be unlocked by releasing first leg 131 of inside handle 132 or by retracting locking cylinder 150 into cylindrical housing 146. In either case, first and second springs 138 and 141, respectively, act to return the inside lock handle 132 and cylinder lock link 125 to the right to assume their unlocked positions for normal operation of sliding door 1.

Operation of the Sliding Door Rotary Latch System

Although the operation of the sliding door rotary latch system of the present invention is believed apparent from the above description, an operational statement is set forth hereinafter for purposes of completeness. This operational statement begins with the door in its closed and latched position as illustrated in FIG. 1 with the locking mechanism 121 in its unlocked state.

To open the door, either outside handle 12 or inside handle 19 is pivoted away from the rotary latch assembly 7. This handle movement through inner actuation mechanism 22 pivots forwardly extending cam arm 52 upwardly independent of any movement in rear latch 56. Pivotal movement of cam actuator arm 52 pivots actuator lever 96 which in turn drives stud 100 to pivot tripping pawl 101 about first fixed shaft 103. The resultant counterclockwise movement of tripping pawl 101 as viewed in FIG. 5 releases tripping shoulder 105 from peripheral tripping step 112 on rotary latch 108. Torsion spring 114 then rotates freed rotary latch 108 in a clockwise direction as viewed in FIG. 5 to release the end 18B of strike bar 18 on handle assembly 5.

The sliding door 1 can then be moved to the right as viewed in FIG. 1 by continuing to pull or push on rotated handle 12 or 19. Because rear latch 56 has remained stationary during actuation of cam arm 52, such rear latch 56 is in position to cooperate with rear strike plate 8 when the door reaches its fully open position. As described above, such rear latch 56 is received within slot 68 of rear latch plate 8 with keeper shoulder 57 thereon being behind and in engagement with retention lip 69. With the keeper shoulder 57 retaining the sliding door 1 in its fully open position, the outer handle 12 or inner handle 19 may be released.

With such release, the inner actuation mechanism 22 is returned to its at rest centered position by balancing springs 65A and 65B. This results in cam arm 52 being pivoted downwardly about shaft 54 to its normal operating position. Release of the handle also allows torsion spring 114 to return the tripping pawl 101 to its normal unlatched position with stud 100 returning to the bottom of stud slot 102 and actuating lever 96 being returned to its at rest position.

To close door 1, outside handle 12 or inside handle 19 is pivoted away from rear post 3. This pivotal movement of handle 12 or handle 19 results in the inner actuation mechanism 22 pivoting rear latch 56 upwardly about shaft 54 to free rear latch from retention lip 69 on rear strike plate 8. Sliding door 1 can then be moved forwardly toward its closed position by continuing to pull or push on the actuated outer handle 12 or inner handle 19. This pivotal actuation of such handle does not effect the position of actuating arm 52 because of the lost motion drive connections in the inner actuation mechanism 22. The forwardly extending cam actuator arm 52 is thus in its inactive position where it will not engage actuator lever 96 when the door is closed.

With such closing movement, the leading end 18B of U-shape strike bar 18 engages strike surface 111 on rotary latch 108. The strike bar 18 drives the rotary latch in a counterclockwise direction about second shaft 109 which in turn drives tripping pawl 101 in a clockwise direction about first shaft 103. Full pivotal movement of the tripping pawl is permitted when the locking mechanism 121 is unlocked since the locking slot 128 is in a position which does not interfere with pivotal movement of locking projection 104 thereon. When the leading end 18B of strike bar 18 engages the blind ends of first and second strike slots 82 and 93, the tripping shoulder 105 on tripping pawl 101 has caught in peripheral tripping step 112 of rotary latch 108 to retain rotary latch in its closed position capturing the forward vertical end 18B of strike bar 18. Because of the vertical orientation of the strike bar, the sliding door 1 has some freedom for vertical movement in its latched condition. This latched position returns the sliding door rotary latch system to the initial position described in this operational statement.

As will be appreciated, the locking mechanism could be actuated positively to retain the door 1 in its closed and latched position. For this purpose, the door could be locked from the outside by actuating the key and advancing locking cylinder 150 to the phantom line position of FIG. 5 wherein the right end 128A of slot 128 blocks arcuate movement of locking projection 104 on tripping pawl 101. Similarly, the inside lock handle could be manually actuated to the left as viewed in FIG. 5 to position the right end 128A of slot 128 in its locking position blocking rotary movement of locking projection 104 on tripping pawl 101.

It will be apparent from the foregoing that changes may be made in the details of construction and configuration without departing from the spirit of the invention as defined in the following claims. For example, the locking mechanism could be modified to include different structural means for selectively blocking pivotal movement of the tripping pawl.

We claim:

1. A sliding door rotary latch system comprising:

a handle assembly mounted on the sliding door and having inside and outside handles;

a rotary latch assembly mounted on a front vertical post partially defining a door opening;

a rear strike plate mounted on a back vertical post partially defining the door opening;

the handle assembly including (a) a forwardly extending, pivotal cam actuator arm, (b) a forwardly extending strike bar selectively cooperating with the rotary latch assembly to hold the sliding door in a closed position covering the door opening, (c) a rearwardly extending, pivotal rear latch selectively cooperating with the rear strike plate to hold the door in an open position exposing the door opening, and (d) an inner actuation mechanism allowing the inner and outer handles to be selectively operated independently of one another to pivot either the cam actuator arm or the rear latch independent of the other, the cam actuator arm being formed to release the rotary latch upon selective pivotal movement of said cam actuator arm when the sliding door is closed to allow the sliding door to be opened and selective pivotal movement of the rear latch releasing that rear latch from the rear strike plate when the sliding door is fully open to allow the sliding door to be closed.

2. The sliding door rotary latch system of claim 1 wherein the inner and outer handles are mounted on opposite sides of the sliding door in transversely aligned, but vertically spaced relationship relative to one another.

3. The sliding door rotary latch system of claim 2 wherein the inner actuation mechanism includes a first tumbler body selectively pivotally actuated by pivotal movement of the outside handle, a second tumbler selectively pivotally actuated by pivotal movement of the inside handle, and linkage means extending therebetween and including lost motion drive means for the cam actuator arm and rear latch operative to allow either the cam actuator arm or rear latch to be pivoted independently of the other by pivotal movement in the selected direction of either the inner or outer handle.

4. The sliding door rotary latch system of claim 3 wherein the first tumbler has a first body including a first center section and first and second arms extending outwardly therefrom in generally opposite directions, and said second tumbler has a second body including a second center section and third and fourth arms extending outwardly therefrom in generally opposite directions.

5. The sliding door rotary latch system of claim 4 wherein the linkage means has a first link pivotally connected at one end to the first arm, a second link pivotally connected at one end to the second arm, a third link pivotally connected at one end to the third arm and a fourth link pivotally connected at one end to the fourth arm.

6. The sliding door rotary latch system of claim 5 wherein the first and third links have overlapping ends with a normally aligned first pair of elongated slots therein and the second and fourth links have overlapping ends with a normally aligned second pair of elongated slots therein.

7. The sliding door rotary latch system of claim 6 wherein the cam actuator arm and the rear latch are commonly pivoted adjacent their proximal ends about a fixed pivot shaft in the handle assembly, the rear latch has a first drive pin thereon received in the first pair of elongated slots to form a first lost motion drive connection and the cam actuator arm has a second drive pin thereon received in the second pair of elongated slots to form a second lost motion drive connection.

8. The sliding door rotary latch system of claim 7 wherein the lost motion drive means comprise the first and second lost motion drive connections, and the first and second drive pins are positioned at the same relative position in their respective pairs of slots in an at rest position of the handle assembly.

9. The sliding door rotary latch system of claim 8 wherein the inner actuation mechanism is spring biased to return the handle assembly to its at rest position when the inner or outer handle is released.

10. The sliding door rotary latch system of claim 9 wherein the first center section on the first tumbler has a first square hole therein receiving a first square shank connected to and extending from the pivotal outside handle and the second center section on the second tumbler has a second square hole therein for receiving a second square shank connected to and extending from the pivotal inside handle.

11. The sliding door rotary latch system of claim 1 or 3 wherein the rotary latch means includes a rotary latch having an open position and a closed position, the rotary latch in its closed position selectively temporarily capturing the forwardly and vertically extending strike bar when the door is closed.

12. The sliding door rotary latch system of claim 11 wherein the rotary latch means further includes a pivotal trip pawl having a neutral position and a holding position, the pivotal trip pawl in its holding position selectively temporarily securing the rotary latch in its closed position.

13. The sliding door rotary latch system of claim 12 wherein the rotary latch means further includes a pivotal actuator lever having its distal end in engagement with a tripping stud on the trip pawl.

14. The sliding door rotary latch system of claim 13 wherein the rotary latch means further includes a spring means normally to bias the rotary latch toward its open Position and the trip pawl toward its neutral position, the pivotal actuator lever being pivoted by selective pivotal movement of the forwardly extending cam actuator arm to pivot the trip pawl away from its holding position, thereby to release the rotary latch for movement from its closed position to its open position to release the forwardly and vertically extending strike bar allowing the sliding door to be opened.

15. The sliding door rotary latch system of claim 14 wherein the rotary latch means includes a lock means selectively to preclude pivotal movement of the trip pawl, thereby to lock the rotary latch means.

16. The sliding door rotary latch system of claim 15 wherein the lock means includes first lock actuation means outside the door and second lock actuation means inside the door.

17. The sliding door latch system of claim 15 wherein the lock means includes a sliding lock bar having an elongated slot therein, said sliding lock bar having an unlocked position wherein s projecting lock portion of the trip pawl is free to move within the elongated slot and a locked position wherein the projecting lock portion of the trip pawl engages an end of the elongated slot to block movement of the trip pawl, thereby to lock the rotary latch means.

18. The sliding door latch system of claim 17 wherein the lock means includes first lock actuating means outside the door selectively operative to move the sliding lock bar to its locked position, second lock actuating means inside the door selectively operative to move the sliding lock bar to its locked position, and spring means to return the sliding lock bar to its unlocked position when the first or second lock actuating means is released.

19. The sliding door latch system of claim 18 wherein the first locking means includes a key operated locking cylinder which may be advanced or retracted upon key movement, advancement of the locking cylinder being operative to drive the sliding lock bar from its unlocked position to its lock position.

* * * * *